US009062545B2

(12) United States Patent
Roberts et al.

(10) Patent No.: US 9,062,545 B2
(45) Date of Patent: Jun. 23, 2015

(54) HIGH STRAIN RATE METHOD OF PRODUCING OPTIMIZED FRACTURE NETWORKS IN RESERVOIRS

(75) Inventors: Jeffery James Roberts, Livermore, CA (US); Tarabay H. Antoun, Danville, CA (US); Ilya N. Lomov, Livermore, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 434 days.

(21) Appl. No.: 13/533,795

(22) Filed: Jun. 26, 2012

(65) Prior Publication Data

US 2013/0341029 A1 Dec. 26, 2013

(51) Int. Cl.
*E21B 43/263* (2006.01)

(52) U.S. Cl.
CPC ..... *E21B 43/263* (2013.01)

(58) Field of Classification Search
CPC ..... E21B 43/263; E21B 43/117; E21B 29/00
See application file for complete search history.

(56) References Cited

U.S. PATENT DOCUMENTS

| | | | | |
|---|---|---|---|---|
| 3,771,600 | A | 11/1973 | Hill et al. | |
| 3,951,458 | A | 4/1976 | Cathles et al. | |
| 4,220,205 | A | 9/1980 | Coursen et al. | |
| 4,223,734 | A | 9/1980 | Lekas et al. | |
| 4,239,286 | A * | 12/1980 | Coursen | 299/4 |
| 5,722,490 | A | 3/1998 | Ebinger et al. | |
| 6,230,805 | B1 | 5/2001 | Vercaemer et al. | |
| 6,732,799 | B2 | 5/2004 | Challacombe et al. | |
| 2011/0277996 | A1 | 11/2011 | Cullick et al. | |
| 2012/0073836 | A1 | 3/2012 | Sanders et al. | |
| 2012/0111560 | A1 | 5/2012 | Hill et al. | |
| 2012/0152570 | A1 | 6/2012 | Thomas | |

FOREIGN PATENT DOCUMENTS

| | | |
|---|---|---|
| WO | 9629567 | 9/1996 |

OTHER PUBLICATIONS

Parrish et al., "The Rock Spring Site 12 Hydraulic/Explosive True in Situ Oil Shale Fracturing Experiment," Sandia National Laboratories, SAND 80-0836 Unlimited Release, Category No. UC91 (1980).

* cited by examiner

*Primary Examiner* — Zakiya W Bates
(74) *Attorney, Agent, or Firm* — Eddie E. Scott

(57) ABSTRACT

A system of fracturing a geological formation penetrated by a borehole. At least one borehole is drilled into or proximate the geological formation. An energetic charge is placed in the borehole. The energetic charge is detonated fracturing the geological formation.

25 Claims, 13 Drawing Sheets

HIGH STRAIN RATE METHOD OF PRODUCING OPTIMIZED FRACTURE NETWORKS IN RESERVOIRS

STATEMENT AS TO RIGHTS TO INVENTIONS MADE UNDER FEDERALLY SPONSORED RESEARCH AND DEVELOPMENT

The United States Government has rights in this invention pursuant to Contract No. DE-AC52-07NA27344 between the United States Department of Energy and Lawrence Livermore National Security, LLC for the operation of Lawrence Livermore National Laboratory.

BACKGROUND

1. Field of Endeavor

The present invention relates to geologic reservoir stimulation and more particularly to geologic reservoir stimulation by explosively-augmented fracturing in wellbore sidetracks.

2. State of Technology

U.S. Pat. No. 6,732,799 for apparatus for stimulating oil extraction by increasing oil well permeability using specialized explosive detonating cord provides the state of technology information reproduced below. The disclosure of U.S. Pat. No. 6,732,799 is incorporated herein in its entirety by this reference.

Oil wells have been known to produce oil for nearly seventy-five (75) years. Oil wells that have been producing oil for several years often experience a reduction in oil extraction or production as the years progress. When the oil production is reduced, remedial action in the form of stimulation to improve the oil production output of the oil well is undertaken.

Generally, such stimulation may involve improvement of the permeability or transmissibility of the reservoir itself or merely clearing the casing perforations of accumulated production-restricting contaminants, such as heavy hydrocarbons, paraffins, tars, mineral depositions, or formational fines in or near the casing perforations, by the use of vibratory explosive forces created by the ignition of a detonator and detonating cord.

Typically, the methods used to increase the transmissibility of sand, shale or rock formation are shock treatments using explosives, acid washes, hydraulic fracturing, and high energy gas fracturing.

The flow rate of a fluid such as oil through a porous medium, such as a sand, shale or rock formation, is a function of the permeability or transmissibility of that particular formation. If the transmissibility of oil from an oil bearing formational reservoir can be increased, more fluid can be recovered. It is well known that over the life of an oil or gas well, with continued pumping or removal of the oil or gas from that well, the permeability of the surrounding formation may be economically insufficient to justify continued production, even though a large percentage of fluid hydrocarbons remain. When this occurs, the oil well operator can either abandon the oil well or can attempt to increase the permeability of that formation to rejuvenate the flow of liquid hydrocarbons there through.

There are currently a number of techniques or processes for mechanically increasing permeability. The best known processes are: (1) hydraulic fracturing; (2) explosive fracturing; (3) acidizing, and (4) high energy gas fracturing.

Hydraulic Fracturing

Hydraulic fracturing is a process used for increasing the permeability of a rock formation by a slow introduction of a highly viscous fluid that is pumped into the area of a well bore between packings. In the hydraulic fracturing technique, the combined fluid pressure is steadily increased until the tensile strength of that particular rock material is exceeded. When this occurs, a fracture will be initiated which propagates from opposite sides of the well bore into the formation; this is known as a biwing fracture. This fracture is induced at a point of least resistance in the rock material.

A fluid used in practicing such a method is one selected to be sufficiently viscous to enable the suspension and mass transport of proppants suspended therein. Such proppant materials are either sand grains or grains of a synthetic material and are made to pass into and settle in the induced fracture. So arranged, the proppants prevent the induced fracture from totally closing once the pressure on the fluid is reduced and the normal closing pressures of the rock formation are re-exerted. Hydraulic fracturing generally involves the generation of the single biwing fracture that extends in a vertical plane from opposite sides of the well bore into the rock formation. In such fracturing, the injected fluids will, by and large, remain in the formation, and the proppants used to support the fracture may, due to compaction, actually come to restrict the permeability of that rock formation rather than enhance or improve its permeability. Another drawback to the use of hydraulic fracturing, and of major consideration in selecting a rock formation fracturing process, is the extent and expense of the equipment and labor involved, since the hydraulic fracturing method requires the use of hydraulic pumps with a high pressure capability along with the temporary positioning of a packer above the oil bearing strata.

Explosive Fracturing

In an attempt to overcome the limitations of hydraulic fracturing where generally only a single biwing fracture is produced, explosives have been used for dynamically loading a rock formation. Because of the speed of burning of an explosive, and the shock wave produced thereby, it has been found that explosive compaction of the formation rock around the well bore opposite the explosion may actually decrease rather than increase the permeability of the rock formation. Therefore, while explosive fracturing may provide a greater circumferential fracturing effect in a rock formation, it may also depredate the permeability of the rock formation to the point where most, if not all, permeability is lost. Explosive fracturing has been, therefore in the past, generally considered unpredictable and unreliable.

Acid Fracturing

Acid fracturing is a process which is utilized to increase permeability by dissolving reactive materials in a rock formation to create conductive passageways or "worm holes" and for chemically etching the oppositely disposed faces of a rock formation fracture. The acids which are frequently used are concentrated solutions of hydrofluoric and hydrochloric acid, either of which can, of course, create serious safety problems in the transportation and conveyance of such highly corrosive fluids to a desired location in an oil well bore.

Furthermore, acidizing is limited by a danger of formation matrix collapse due to excessive rock dissolution near the well bore as a consequence of a preferential invasion of the acid used into zones of high, rather than low, permeability.

Another limitation found in the use of the acidizing technique, is that the depth of penetration is limited by the type of rock in the rock formation and the degree of the strength of the acid. Many times, these acidizing processes have been found to cause extensive damage to the well bore due to the geochemical reactions produced. Therefore, the nature of the materials at the location where the fracture is to be induced must be identified prior to selection of the acid to be used.

Where such unwanted geochemical reactions take place, they can create damage, leading even to a loss of permeability.

High Energy Gas Fracturing

Propellant deflagration is a recent technology that has been developed to produce a good distribution of fractures in the oil-bearing rock formation around a well bore without the problems that have been inherent in the explosive and acid processes.

In the use of high energy gas fracturing, a significant amount of high energy is created by a deflagrated propellant that is ignited in a well bore adjacent to a rock formation to be fractured. Upon ignition of the propellant in the canister, high-energy gas and other products of this combustion process, such as water vapor or steam, are driven to near sonic velocities.

The propellant can be burned radially from a longitudinal center cavity within the propellant, or can be burned from one end, as in a cigarette burn, or a combination of both processes can be employed to develop the high energy fracturing process.

In practice, high-energy gas fracturing involves the placement of a canister of a propellant adjacent to a perforated wall of a well bore in the zone where it is desired to increase the permeability of the oil-bearing rock formation. An igniter rod is then implanted adjacent to the canister containing the propellant. To ignite the propellant, an electrical current is transmitted over one or more electrical wires from the surface above the entrance to the oil well bore to instantaneously detonate an electric blasting cap which initiates deflagration thereof in a period of milliseconds. Once deflagration occurs, a high volume of pressurized gas and water is generated at near sonic velocities. By such deflagration, the energy loading in the oil well bore will be propagated much faster than that which occurs during hydraulic fracturing. Such an increase in the propagation speed of the energy loading produces multiple fractures in directions other than in the plane of least resistance through the oil-bearing rock formation surrounding the oil well bore. The propellant is selected from a group of propellants which will burn at a far slower rate than those propellants used for typical explosive detonations. No destructive shock wave will, therefore, be generated in a propellant deflagration which would cause crumbling of the material around the well bore.

U.S. Pat. No. 3,771,600 for a method of explosively fracturing from drain holes using reflective fractures provides the state of technology information reproduced below. The disclosure of U.S. Pat. No. 3,771,600 is incorporated herein in its entirety by this reference.

Extraction of oil or gas as well as the leaching of underground minerals is often complicated by the lack of permeability in the formation. In order to maximize production from such low permeability formation, it is often necessary to fracture the formation and thereby increase permeability. There are two basic methods of creating fractures in a formation. One is to create hydraulic fractures by applying a pressurized fluid against the formation until the formation parts. Another method is to detonate explosives in the formation or wellbore to create a shock wave which fractures the rock matrix of the formation.

Explosive well stimulation has been used for many years. However, explosive stimulation has not been entirely successful. As a result, hydraulic fracturing introduced over 20 years ago has been the standard stimulation mode, due mainly to the high degree of success of this method. Recently, however, new interest in stimulating wells with explosives has been generated by the development of improved explosives and new methods of using them. There are presently two basic methods of explosive fracturing. One is to detonate the explosive in the wellbore, and the other is to detonate the explosive in the formation adjacent to the wellbore. A method of detonating explosives in the formation adjacent the wellbore is to hydraulically fracture the formation, and then load the fracture zone with an explosive material.

When the explosive is confined in the wellbore, the result of detonation is a cylindrical rubble zone in the vicinity of the wellbore surrounded by a system of vertical fractures radiating like wheel spokes from the rubble zone. This result is achieved by the explosive undergoing a very rapid self-propagating decomposition. This decomposition yields more stable products in the form of gases which exert tremendous pressure as they expand at the high temperature generated by the release of heat. This rapid release of energy creates a shock wave.

The rock matrix, adjacent to an explosive charge, will be shattered as the shock wave moves through it. The shock wave consists of two components, compression wave and a shear wave. When the energy level of either of these waves exceeds the strength of the rock under dynamic loading, the rock will fail, thus creating a fracture network. The gases generated in the explosion obtain a pressure on the order of one million pounds per square inch, which pushes against the exposed surfaces of the fractured rock matrix. The expansion of gases will extend the fractures until its energy for doing work is dissipated.

When the explosives are placed in the formation, usually in a fracture created by hydraulic means, a rubble zone will be created in the fracture area upon detonation of the explosive. When an explosive is located in a horizontal fracture and detonated, a high pressure shock wave shatters the adjacent surfaces of the fracture. as the shock wave moves upward and downward from the plane of detonation, it will traverse various strata. As the wave moves through a density discontinuity, part of the wave will be reflected back as a tension wave. The tensile strength of rock is several orders of magnitude less than the compressive strength, therefore new fractures will be created by the tension wave.

Explosive detonations occurring in vertical fractures yield similar results as those occurring in horizontal fractures. Lateral expansion of the original fracture occurs more readily, however, since the vertical height of the fracture is confined by the stratographic boundaries, thus requiring a smaller volumetric increase for fracture extension. Placement of explosives in fractures is not entirely satisfactory due to the limited amount of explosives that can be placed in a fracture created by hydraulic means. The width of fracture controls the net thickness of the explosive layer and thus limits the volume of gas products available for fracture extension. Since the explosive is present as a thin layer, a limited quantity of gas is available per unit surface area of the fracture. It thus can be seen that it will be advantageous to be able to place a larger volume of explosive in the formation. Additionally it is preferable to locate the explosive in the formation rather than in the wellbore so as to prevent wellbore damage and sloughing of the formation adjacent the wellbore.

Since the tensile strength of rock is appreciably less than its compressive strength, it would be preferable to devise a process of explosive fracturing which utilizes a tension wave to a greater degree than is now being practiced. The use of more explosives in the formation together with greater use of tension waves would result in more effective stimulation of the formation.

One method of providing space for more explosives in the formation is by use of drain holes. Drain holes are simply boreholes drilled along a horizontal plane into the formation being produced to provide for more efficient recovery through increased drainage area. The history of drain holes goes back past the turn of the century with early work done in the 1930's. This work was largely unsuccessful due to the economics of the reservoir in which it was used. Revival of drain holes occurred in the 1950's for a brief period and had some success.

Since a 5½ inch hole can be easily drilled by presently known drain hole drilling methods, it can readily be seen that s significantly increased amount of explosives can be located in such a drain hole. Since windows can be cut in the casing and drain holes drilled through the casing window, drain hole drilling is not limited to new wells. Since explosive stimulation is often used in fields that have already been drilled, the casing window feature of drain holes is extremely advantageous.

SUMMARY

Features and advantages of the present invention will become apparent from the following description. Applicants are providing this description, which includes drawings and examples of specific embodiments, to give a broad representation of the invention. Various changes and modifications within the spirit and scope of the invention will become apparent to those skilled in the art from this description and by practice of the invention. The scope of the invention is not intended to be limited to the particular forms disclosed and the invention covers all modifications, equivalents, and alternatives falling within the spirit and scope of the invention as defined by the claims.

The present invention provides a method, apparatus, and system of fracturing a geological formation. At least one borehole is drilled extending into or proximate the geological formation. An energetic charge is placed in the borehole. The energetic charge is detonated fracturing the geological formation.

In one embodiment, the present invention provides a method, apparatus, and system of fracturing a geological formation penetrated by a main borehole or proximate the main borehole. At least one side borehole is drilled extending from the main borehole into or proximate the geological formation. An energetic charge is placed in the side borehole away from the main borehole. The side borehole is isolated from the main borehole. The energetic charge is detonated fracturing the geological formation.

In one embodiment the present invention provides a method, apparatus, and system of fracturing a geological formation penetrated by a well or proximate the well including the steps of drilling a side borehole from the well so that the side borehole extends into or proximate the geological formation, hydrofracking the geological formation resulting in a fluid in the geological formation, isolating the side borehole from the well with the fluid pressurized and producing a stress field in the geological formation, and energetically stimulating the fluid in the geological formation fracturing the geological formation resulting in the stress field in the geological formation being enhanced. The method, apparatus, and system in one embodiment include pre-determining the location of the side borehole to increase expanding and enhancing fracturing the geological formation. The method, apparatus, and system in one embodiment includes pre-determining the location of the explosive charge to maximize the step of energetically stimulating the fluid in the geological formation fracturing the geological formation resulting in the stress field in the geological formation being enhanced. The method, apparatus, and system in one embodiment includes pre-determining the timing of detonation of the explosive charge to maximize the step of energetically stimulating the fluid in the geological formation fracturing the geological formation resulting in the stress field in the geological formation being enhanced.

In another embodiment the present invention provides a method, apparatus, and system of fracturing a geological formation penetrated by a main borehole or proximate the main borehole including the steps of drilling a pattern of side boreholes from the main borehole into or proximate the geological formation, emplacing energetic charges in the side boreholes away from the main borehole, isolating the side boreholes from the main borehole, and detonating the energetic charges and fracturing the geological formation. The method, apparatus, and system in one embodiment include pre-determining the location of the side boreholes to enhance fracturing the geological formation. The method, apparatus, and system in one embodiment includes pre-determining the location of the energetic charges in the side boreholes to enhance fracturing the geological formation. The method, apparatus, and system in one embodiment includes pre-determining the timing of detonating the energetic charges to enhance fracturing the geological formation.

The present invention has use in all applications that currently use conventional hydrofracturing techniques and in applications that do not currently use conventional hydrofracturing techniques. One of the main applications is oil and gas well stimulation where hydraulic fracture stimulation is used to increase oil and gas recovery. The present invention is of particular interest in tight gas formations where conventional hydrofracturing techniques do not appear to produce the desired results. Another application is in Enhanced Geothermal Systems (EGS) where hydraulic fracturing is also used to create fracture networks which enhance the permeability of the rock and are used in the generation of geothermal energy The invention is susceptible to modifications and alternative forms. Specific embodiments are shown by way of example. It is to be understood that the invention is not limited to the particular forms disclosed. The invention covers all modifications, equivalents, and alternatives falling within the spirit and scope of the invention as defined by the claims.

BRIEF DESCRIPTION OF THE DRAWINGS

The accompanying drawings, which are incorporated into and constitute a part of the specification, illustrate specific embodiments of the invention and, together with the general description of the invention given above, and the detailed description of the specific embodiments, serve to explain the principles of the invention.

DETAILED DESCRIPTION OF SPECIFIC EMBODIMENTS

Figure 1:
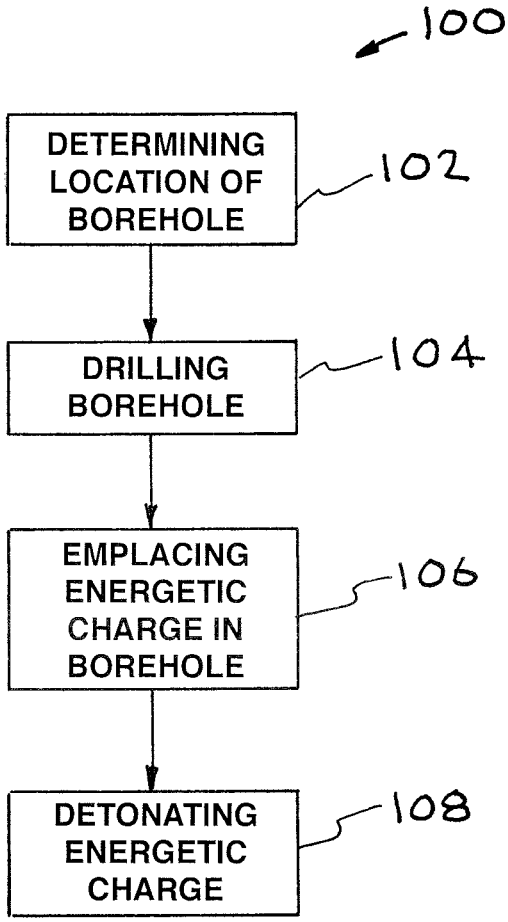
FIG. 1 illustrates a system of the present invention.

Referring to the drawings, to the following detailed description, and to incorporated materials, detailed information about the invention is provided including the description of specific embodiments. The detailed description serves to explain the principles of the invention. The invention is susceptible to modifications and alternative forms. The invention is not limited to the particular forms disclosed. The invention covers all modifications, equivalents, and alternatives falling within the spirit and scope of the invention as defined by the claims.

The present invention provides a method, apparatus, and system for fracturing a geological formation wherein at least one borehole is drilled extending into or proximate the geological formation and an energetic charge is placed in the borehole. When the energetic charge is properly placed and detonated it results in improved fracturing the geological formation.

Definitions

The terms below used in this patent application have the following meanings:

Optimal, Optimize, Optimized, Optimizing—The point at which the condition, degree, or amount is the most favorable or is an improvement over the prior art.

Hydraulic fracturing, hydrofracking, fracking, hydroshearing—Forcing open of fissures in subterranean formations.

Energetic Charge—Release of energy in a sudden manner with the generation of high pressure.

Pressurized—Produce or maintain raised pressure.

Geothermal—Of or relating to the internal heat of the earth.

Explosives are widely used to break up various types of rock in mining operations. They have also been utilized to a much lesser extent, and with less success to create fracture networks in the subsurface. The main difference between the successful use of explosives in mining applications and the less successful use of explosives to create fracture networks in the subsurface is the in situ stress field. In mining, explosives are most commonly utilized near the ground surface where the in situ stresses are low and where wave reflections from free surfaces in the vicinity of the explosion lead to the propagation of release waves back toward the detonation point, giving rise to fracture-enhancing tensile stress states within the geologic medium. In contrast, the resource of interest in most energy applications, whether it is oil, gas or geothermal energy, is located deep beneath the ground surface, where there are no free surfaces to promote wave reflections, and where the in situ stress field is in a predominantly compressive stress state, which tends to suppress and inhibit fracture propagation. For these reasons, simply detonating an explosive charge in the bottom of a borehole in the subsurface is not likely to produce the desired effects.

The present invention provides a method, apparatus, and system of fracturing a geological formation. At least one borehole is drilled extending into or proximate the geological formation. An energetic charge is placed in the borehole. The energetic charge is detonated fracturing the geological formation. The present invention will be further explained, illustrated, and described in the following examples of systems of the present invention.

EXAMPLE 1

Referring now to the drawings, and in particular to FIG. 1, a flow chart illustrates a system representing an example of one embodiment of the present invention. The system is designated generally by the reference numeral 100. The system 100 is a system of fracturing a geological formation. The system 100 includes the steps shown in the flow chart.

The location of the borehole or boreholes is determined in step 1. Step 1 is designated by the reference numeral 102 in the flow chart of FIG. 1. The size and location of the borehole or boreholes is determined based on a multiplicity of factors including structural geology of the reservoir, the properties of the rock (e.g., sound speed, strength, density, existing fractures), the type of energetic materials being utilized (e.g., energy content per unit volume, energy release rate), and the in situ stress field. Detonation of the energetic materials in the borehole or boreholes can be synchronized to maximize the surface area of the fracture network. Other factors can also be taken into account in the placement and detonation of the energetic materials, such as to maximize propagation of self-propped "shear fractures." Another variant of this approach involves the utilization of explosives placed in discrete locations within a drill hole, as opposed to being placed uniformly throughout the entire length of the hole. In this case, widening of the hole to accommodate larger amounts of explosives at desirable locations may be required to achieve desired results.

Step 2 comprises drilling the borehole or borehole in the locations that have been determined. Step 2 is designated by the reference numeral 104 in the flow chart of FIG. 1.

In step 3 the energetic charge(s) is placed in the borehole or boreholes. Step 3 is designated by the reference numeral 106 in the flow chart of FIG. 1.

Step 4 comprises detonating the energetic charge. Step 4 is designated by the reference numeral 108 in the flow chart of FIG. 1. In one embodiment the step 108 comprises detonating an explosive in the borehole or boreholes.

In one embodiment, the present invention provides a system using explosives, or other energetic materials, to greatly expand and enhance a pre-existing fracture network. The present invention can combine explosive and/or other energetic material with other fracturing techniques to enhance the fracture network well beyond what could be achieved without the present invention. The system of the present invention involves placing an explosive or energetic charge within the borehole and detonating the charge. The energy released by the detonation will be transferred to the surrounding rock formation generating a pressure wave which will cause a significant transient increase in pressure thus leading to enhancement of the fracture network. In one embodiment of the present invention, the charges are placed in small sidetrack boreholes that are cemented off. The smaller boreholes are cheaper to drill, can be arranged in an optimal pattern, and there is no damage to the main borehole while still achieving the desired result. The smaller sidetrack boreholes are sacrificed during the detonation. Arranging the smaller boreholes in a pattern and detonating with specific and carefully planned timing enables the establishment of interfering waves to further control the resulting damage zone and fracture pattern.

EXAMPLE 2

Figure 2:
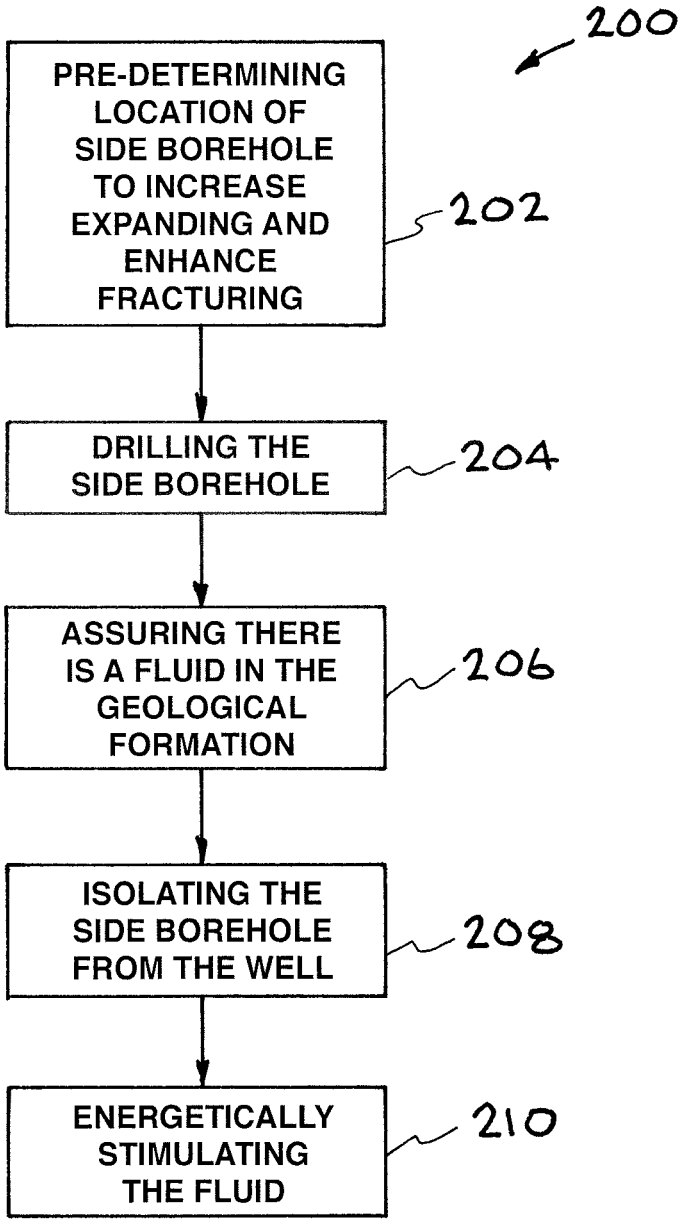
FIG. 2 illustrates an embodiment of a system of the present invention.

Referring now to FIG. 2, a flow chart illustrates another example of a system representing another embodiment of the present invention. The system is designated generally by the reference numeral 200. The system 200 is a system of fracturing a geological formation penetrated by a well or proximate the well. The system 200 includes the steps shown in the flow chart.

In step 1 the location of the side borehole is predetermined so the location increases the expanding and enhances the fracturing the geological formation. Step 1 is designated by the reference numeral 202 in the flow chart of FIG. 2.

In step 2 the side borehole is drilled from the well so that the side borehole extends into or proximate the geological formation. Step 2 is designated by the reference numeral 204 in the flow chart of FIG. 2.

Step 3 comprises modifying the stress state of the formation. This can be done utilizing the fluid in the geological formation that is in fluid communication with the borehole. Step 3 is designated by the reference numeral 206 in the flow chart of FIG. 2. In one embodiment the step 206 comprises hydrofracking the geological formation.

In step 4 the side borehole is isolated from the well with stress field in the geological formation modified. Step 4 is designated by the reference numeral 208 in the flow chart of FIG. 2. In one embodiment the step 208 of isolating the side borehole from the well comprises cementing off the side borehole from the well.

Step 5 comprises energetically stimulating the fluid in the geological formation fracturing the geological formation resulting in the stress field in the geological formation being enhanced. Step 5 is designated by the reference numeral 210 in the flow chart of FIG. 2. In one embodiment the step 210 of energetically stimulating the fluid in the geological formation comprises detonating an explosive in the borehole.

EXAMPLE 3

Figure 3:
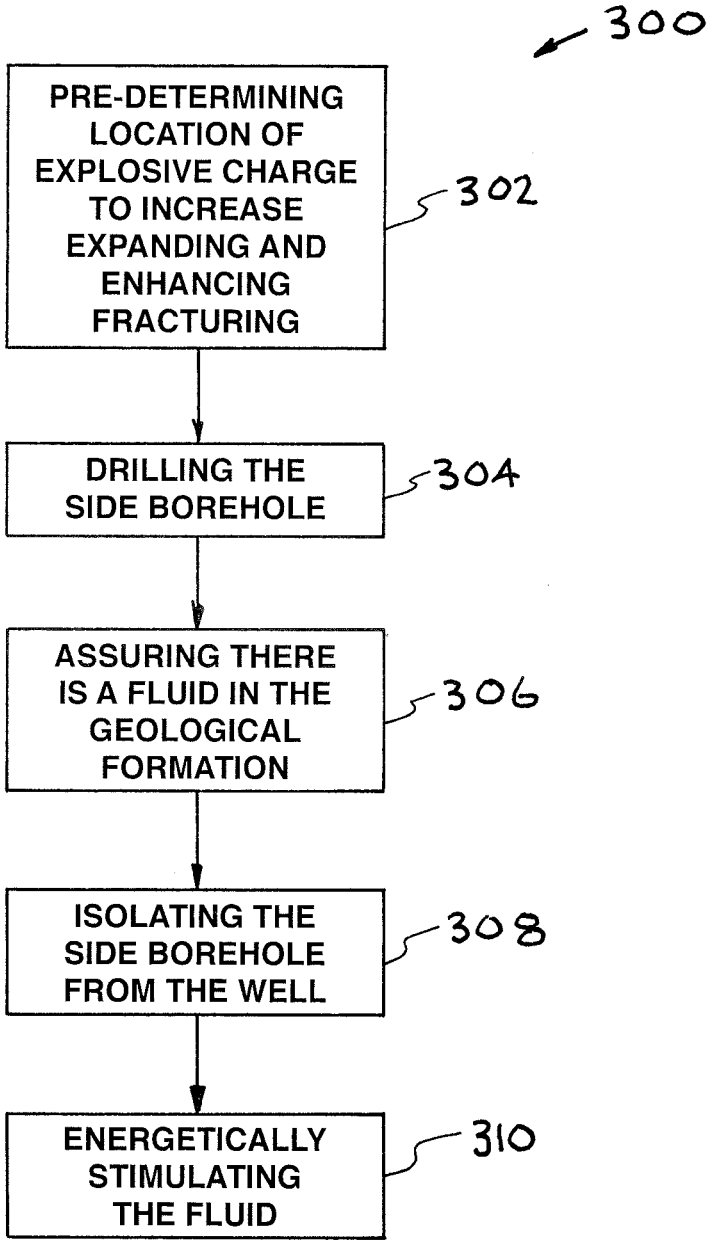
FIG. 3 illustrates another embodiment of a system of the present invention.

Referring now to FIG. 3, a flow chart illustrates an example of a system representing another embodiment of the present invention. The system is designated generally by the reference numeral 300. The system 300 is a system of fracturing a geological formation penetrated by a well or proximate the well. The system 300 includes the steps shown in the flow chart.

In step 1 the location of the location of the explosive charge in the side borehole is predetermined so the location increases the expanding and enhances the fracturing the geological formation. Step 1 is designated by the reference numeral 302 in the flow chart of FIG. 3.

In step 2 the side borehole is drilled from the well so that the side borehole extends into or proximate the geological formation. Step 3 is designated by the reference numeral 304 in the flow chart of FIG. 3.

Step 3 comprises modifying the stress state of the formation. Step 3 is designated by the reference numeral 306 in the flow chart of FIG. 3. In one embodiment the step 306 comprises hydrofracking the geological formation.

In step 4 the side borehole is isolated from the well with the fluid pressurized producing a stress field in the geological formation. Step 4 is designated by the reference numeral 308 in the flow chart of FIG. 3. In one embodiment the step 308 of isolating the side borehole from the well comprises cementing off the side borehole from the well.

Step 5 comprises energetically stimulating the fluid in the geological formation fracturing the geological formation resulting in the stress field in the geological formation being enhanced. Step 5 is designated by the reference numeral 310 in the flow chart of FIG. 3. In one embodiment the step 310 of energetically stimulating the fluid in the geological formation comprises detonating an explosive in the borehole.

EXAMPLE 4

Figure 4:
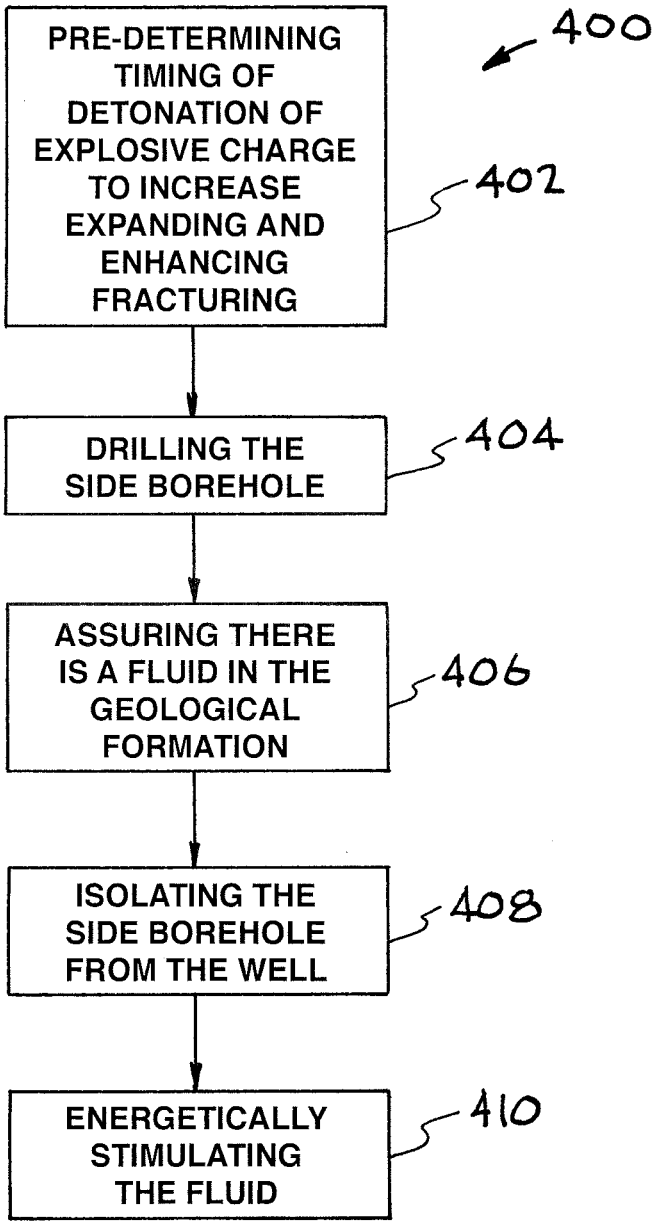
FIG. 4 illustrates yet another embodiment of a system of the present invention.

Referring now to FIG. 4, a flow chart illustrates an example of a system representing another embodiment of the present invention. The system is designated generally by the reference numeral 400. The system 400 is a system of fracturing a geological formation penetrated by a well or proximate the well. The system 400 includes the steps shown in the flow chart.

In step 1 the timing of detonation of the explosive charge is predetermined to increase the expanding and enhances the fracturing the geological formation. Step 1 is designated by the reference numeral 402 in the flow chart of FIG. 4.

In step 2 the side borehole is drilled from the well so that the side borehole extends into or proximate the geological formation. Step 4 is designated by the reference numeral 404 in the flow chart of FIG. 4.

Step 3 comprises hydrofracking the geological formation. This assures there is a fluid in the geological formation that is in fluid communication with the borehole that has been drilled into the formation and modifying the stress state of the formation. Step 4 is designated by the reference numeral 406 in the flow chart of FIG. 4.

In step 4 the side borehole is isolated from the well with the fluid pressurized maintaining the stress field in the geological formation. Step 4 is designated by the reference numeral 408 in the flow chart of FIG. 4. In one embodiment the step 408 of isolating the side borehole from the well comprises cementing off the side borehole from the well.

Step 5 comprises energetically stimulating the fluid in the geological formation fracturing the geological formation resulting in the stress field in the geological formation being enhanced. Step 5 is designated by the reference numeral 410 in the flow chart of FIG. 4. In one embodiment the step 410 of energetically stimulating the fluid in the geological formation comprises detonating an explosive in the borehole.

EXAMPLE 5

Figure 5:
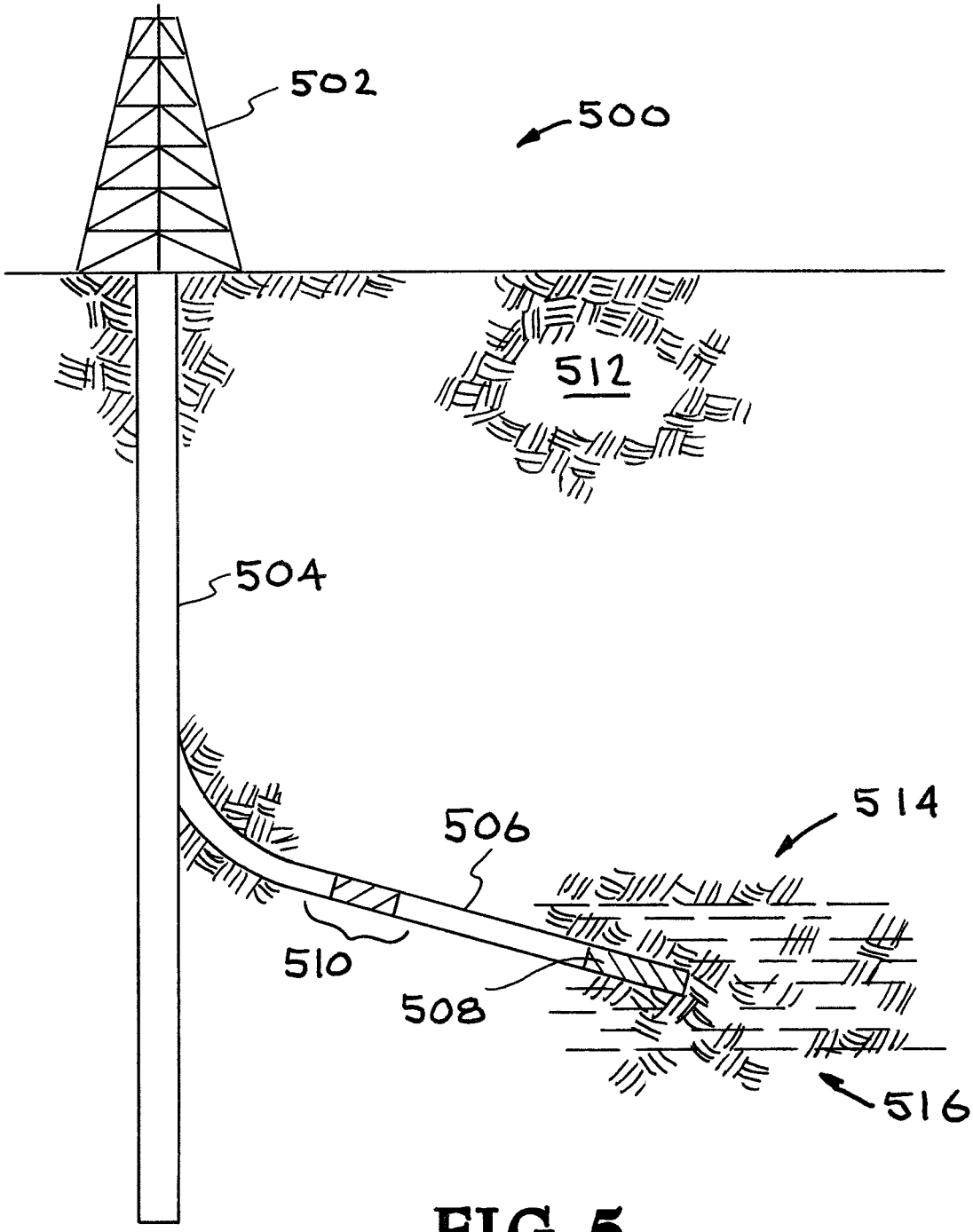
FIG. 5 illustrates an example of the present invention.

Referring now to FIG. 5, one example of a system of the present invention is illustrated. This example is designated generally by the reference numeral 500. The system 500 provides a method, apparatus, and system of fracturing a geological formation penetrated by a main borehole or proximate the main borehole. A well 504 is shown extending into the earth 512 and into or proximate a formation 514 penetrated by the well 504 or proximate the well 504. A derrick 502 is shown above the well 504 for performing operations on the well 504.

A side borehole 506 extends into or proximate the formation 514. An energetic charge 508 is placed in the side borehole 506 away from the main borehole 504. The side borehole 506 is isolated from the main borehole 504 as illustrated by the blocking section 510. The side borehole 506 can be isolated from the main borehole 504 by cementing off the side borehole 506 from the main borehole 504 as illustrated by the cemented section 510. A fluid 516 extends into the geological formation 514. The fluid 514 is isolated from the main borehole 505 by the blocking section 510. The fluid 514 is pressurized producing a stress field in the geological formation 514. The charge 508 is detonated energetically stimulating the fluid 516 in the geological formation 514 fracturing the geological formation 514 resulting in the stress field in the geological formation being enhanced.

EXAMPLE 6

Figure 6:
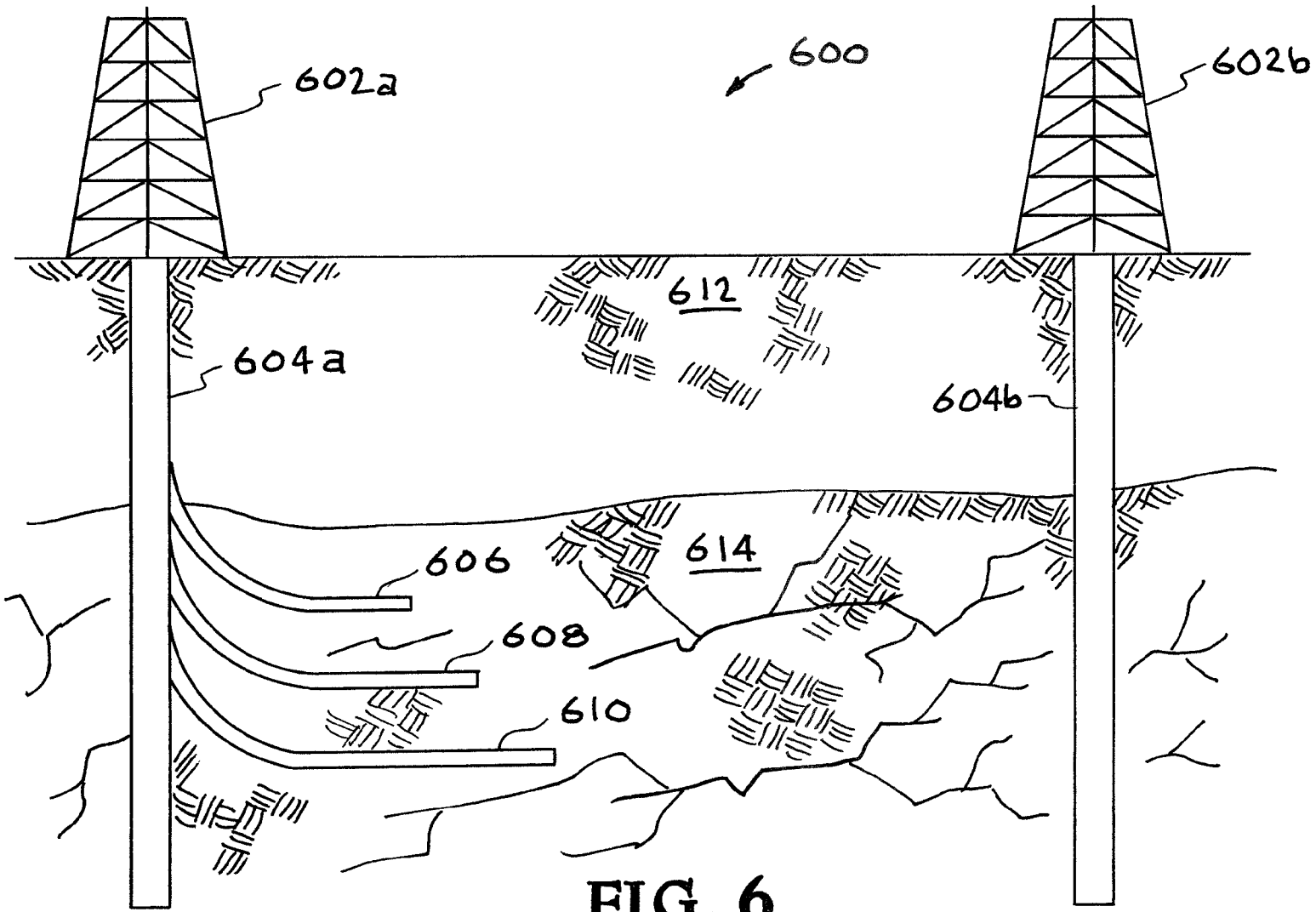
FIG. 6 illustrates another example of the present invention.

Referring now to FIG. 6, another example of a system of the present invention is illustrated. This example is designated generally by the reference numeral 600. The system 600 provides a method, apparatus, and system of fracturing a geological formation penetrated by a main borehole or proximate the main borehole. A first well 604*a* and a second well 604*b* are shown extending into the earth 612 and into or proximate a formation having pre-existing fracture network of a well having a hydraulically fractured productive zone 614 penetrated by the well or wells. The derrick or rigs 602*a* and 602*b* are used for the various operations on the well or wells.

The first well 604*a* penetrates the hydraulically fractured productive zone 614. The first well 604*a* is shown having a side borehole 606 extending into the formation 614 having pre-existing fracture network. The first well 604*a* also has additional side boreholes 608 and 610 extending into the formation 614 having pre-existing fracture network.

The system 600 provides fracturing the geological formation and expanding and enhancing the pre-existing fracture network of the well having a hydraulically fractured productive zone 614 penetrated by or proximate the well 604*a*. The system 600 includes the steps of placing an explosive or energetic charge within one or more of the side boreholes 606, 608 and/or 610, and detonating the charge producing a detonation that is transferred to the pre-existing fracture network 614 in the productive zone penetrated by the well expanding and enhancing a pre-existing fracture network.

Hydraulic fracturing is a well stimulation process used to maximize the extraction of underground resources; including oil, natural gas, geothermal energy, and even water. The oil and gas industry uses hydraulic fracturing to enhance subsurface fracture systems to allow oil or natural gas to move more freely from the rock pores to production wells that bring the oil or gas to the surface.

The process of hydraulic fracturing begins with building the necessary site infrastructure including well construction such as wells 604*a* and 604*b*. Production wells may be drilled in the vertical direction only or paired with horizontal or directional sections. Vertical well sections may be drilled hundreds to thousands of feet below the land surface and lateral sections may extend 1000 to 6000 feet away from the well.

Fluids, commonly made up of water and chemical additives, are pumped into a geologic formation at high pressure during hydraulic fracturing. When the pressure exceeds the rock strength, the fluids open or enlarge fractures that can extend several hundred feet away from the well. After the fractures are created, a propping agent is pumped into the fractures to keep them from closing when the pumping pressure is released. After fracturing is completed, the internal pressure of the geologic formation cause the injected fracturing fluids to rise to the surface where it may be stored in tanks or pits prior to disposal or recycling. Recovered fracturing fluids are referred to as flowback. Disposal options for flowback include discharge into surface water or underground injection.

EXAMPLE 7

Example 7 is an example of energetic stimulation in a geothermal reservoir setting. The goal of a geothermal power plant is to extract hot fluids from the reservoir at a sufficient rate so that the heat can be used to generate electricity. Often times the reservoir contains sufficient heat, but lacks the fracture permeability necessary to extract the volume of water needed for economic electrical generation. Stimulation of the reservoir to create a fracture network that accesses more of the hot reservoir volume is a technique often used to enhance a geothermal system. The rate of heat extraction depends on the temperature of the host formation, the fracture permeability and porosity, and the fracture surface area. The standard method for improving fracture networks in a geothermal reservoir is hydro fracturing or hydroshearing. The system 700 described here relies on higher strain rate stimulation methods that may include, solid, liquid, or gas propellants, explosives, and energetic materials. These methods provide fracture networks for the extraction of heat from the reservoir superior to those created by standard methods.

One implementation strategy is to drill parallel slim-hole sidetracks that extend from the main borehole. These holes are cheaper to drill and using directional horizontal drilling technology can be accurately placed. The holes will extend into the reservoir at a distance such that the emplacement and detonation of an explosive charge will not damage the main borehole. This eliminates one prior problem of using energetic materials for stimulation and adds the advantages of creating the fracture network in a location between injection and extraction boreholes. Thus, once the reservoir is stimulated, the operator can produce fluids from one set of boreholes and reinject the fluids in other boreholes creating a sustainable heat extraction process.

The detonations in the parallel sidetracks can be spatially arranged and timed to create an evolving stress state that enables subsequent detonations to more effectively stimulate the rock volume. The detonations can be used to create constructive or destructive interference patterns of energy propagation to create fractures in regions away from the sidetracks. In this way the integrity of the main borehole is preserved and larger portions of the target reservoir are accessible for heat extraction.

Alternatively, a single sidetrack can extend away from the borehole into the formation and multiple charges can be placed along this borehole. The charges can then be detonated simultaneously or one-at-a-time to create the fracture network and to modify the stress field so that subsequent detonations are more effective at creating the desired fracture network. This single borehole strategy may be advantageous in some situations. For instance, in a reservoir where a fracture networks exists but it does not access portions of the reservoir, this method could target these isolated regions.

Figure 7:
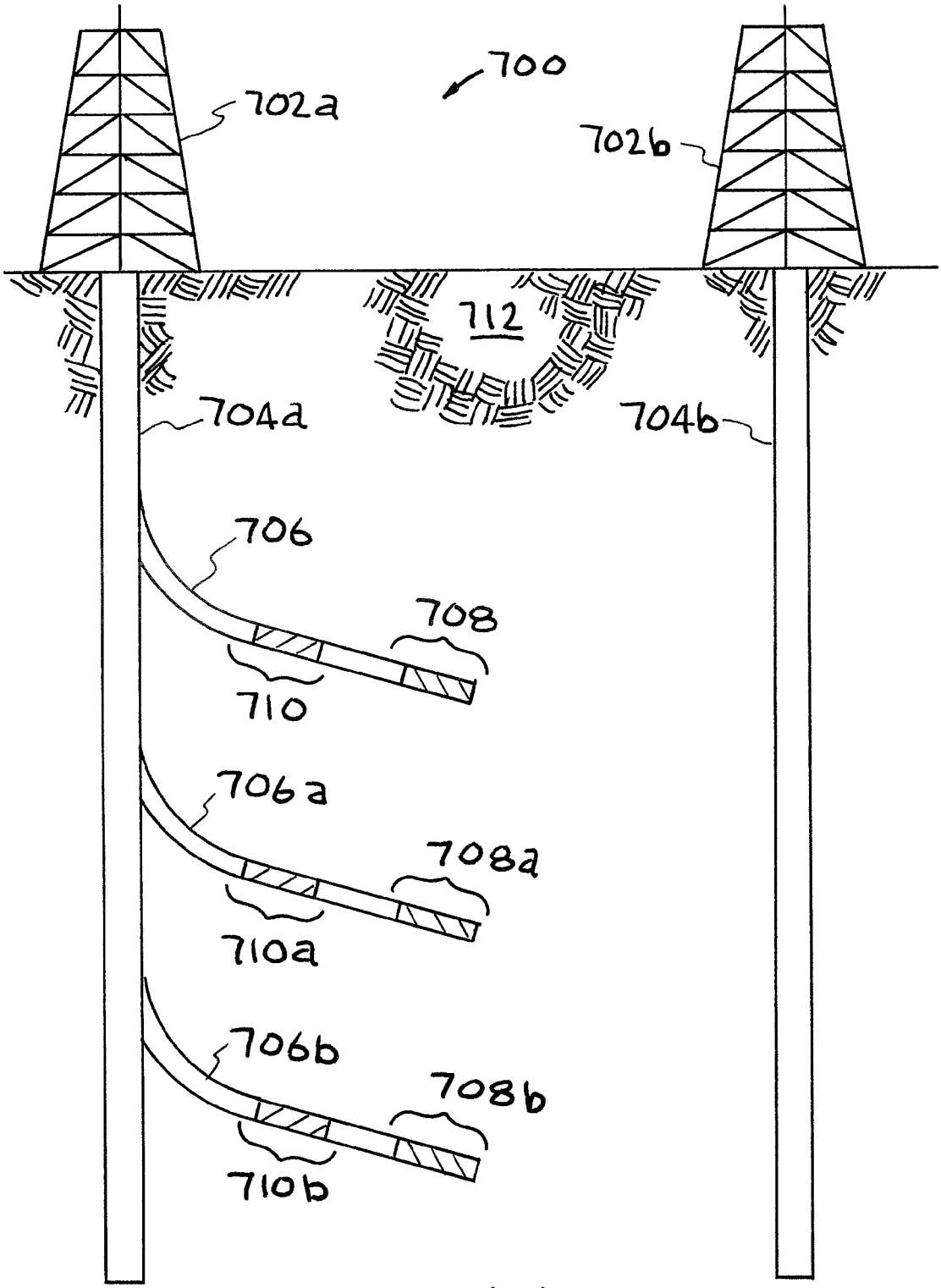
FIG. 7 illustrates an example of the present invention used in connection with a geothermal formation.

Example 7 is illustrated in FIG. 7. The system of Example 7 is designated by the reference numeral 700. A first borehole 704*a* and a second borehole 704*b* are shown extending into the earth 712 and into or proximate a geothermal formation penetrated by the boreholes 704*a* and 704*b*. The first borehole 704*a* is an injection borehole and the second borehole 704*b* is an extraction borehole. The derrick or derrick or rigs 702*a* and 702*b* are used for the various operations on the boreholes.

The first borehole 704*a* is shown having a first side borehole 706, a second side borehole 706*a* and a third side borehole 706*b* extending into the earth 712 and into the geothermal formation. The present invention provides a system 700 for expanding and enhancing a fracture network of a borehole having a geothermal section penetrated by or proximate the borehole including the steps of placing an explosive or energetic charge 708, 708*a*, and 708*b* through the borehole main borehole 704*a* and into the first side borehole 706, into the second side borehole 706*a* and into the third side borehole 706*b*. The first side borehole 706, the second side borehole 706*a* and the third side borehole 706*b* can be sealed off from the main borehole 704*a* as illustrated by the blocking sections 710, 710*a* and 710*b*.

The system 700 expands and enhances a fracture network of a borehole having a geothermal section penetrated by or proximate the borehole by detonating the charges 708, 708*a*, and 708B producing a detonation that is transferred to the geothermal formation penetrated by the borehole expanding and enhancing a fracture network. The system 700 of the present invention can be used for creating a fracture network in geothermal section and/or for expanding and enhancing a pre-existing fracture network.

EXAMPLE 8

Figure 8:
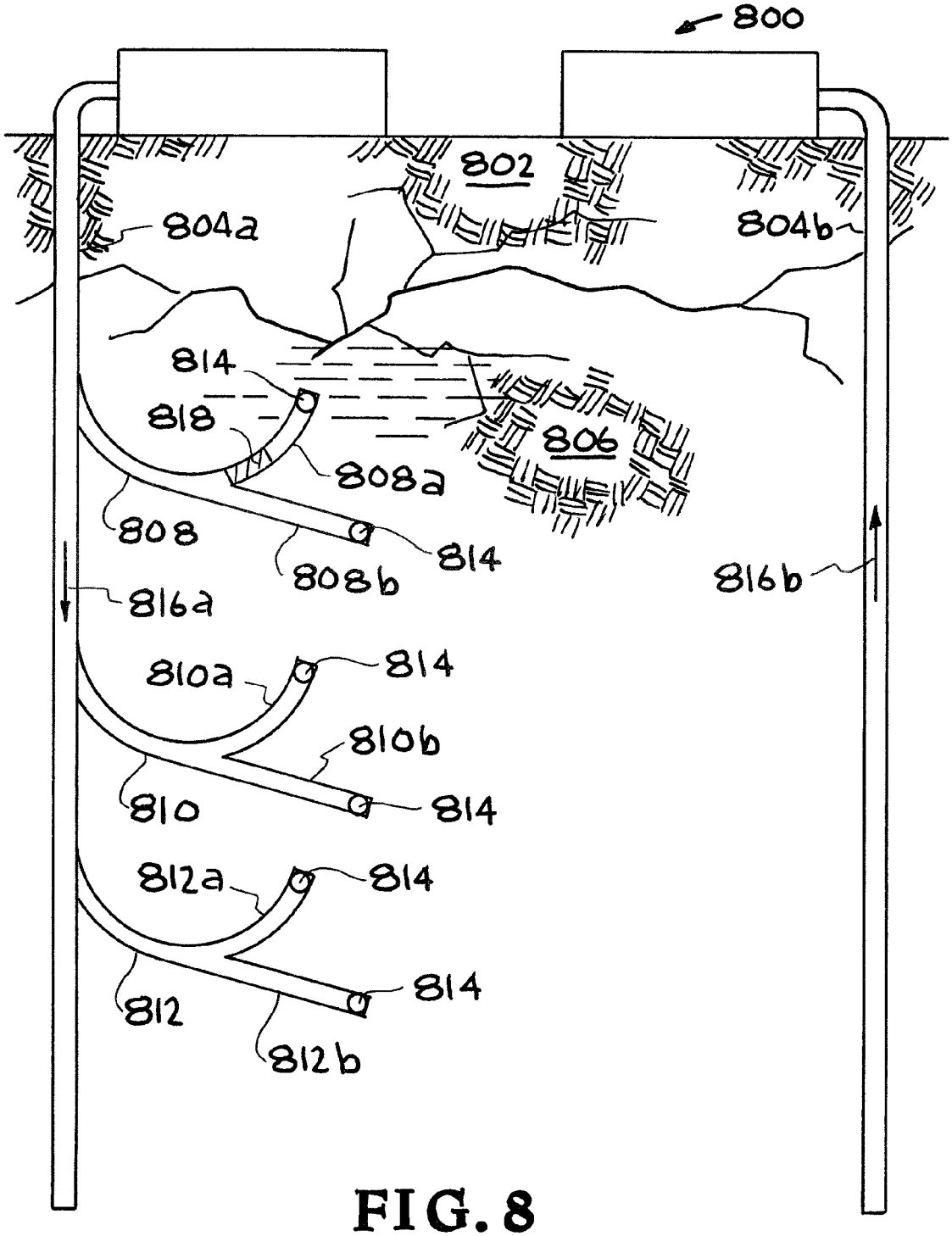
FIG. 8 illustrates another example of the present invention used in connection with a geothermal formation.

Example 8 is another example of energetic stimulation in a geothermal reservoir setting. Example 8 is a more detailed example than example 7. Example 8 is illustrated in FIG. 8. The system of Example 8 is designated by the reference numeral 800. An injection borehole 804*a* and an extraction borehole 804*b* are shown extending into the earth 802 and into a geothermal formation 806. Fluid can be pumped down the injection borehole 804*a*, into and through the geothermal formation 806, and drawn up the extraction borehole 804*b* as illustrated by the arrows 816*a* and 816*b*.

The injection borehole 804*a* is shown having a first side borehole 808 extending into the geothermal formation 806. The first side borehole 808 is shown having an additional side borehole 808*a* and an additional side borehole 808*b* extending into the geothermal formation 806.

The injection borehole 804*a* is shown having a second side borehole 810 extending into the geothermal formation 806. The second side borehole 810 is shown having an additional side borehole 810*a* and an additional side borehole 810*b* extending into the geothermal formation 806.

The injection borehole 804*a* is shown having a third side borehole 812 extending into the geothermal formation 806. The third side borehole 812 is shown having an additional side borehole 812*a* and an additional side borehole 812*b* extending into the geothermal formation 806.

Multiple explosive charges 814, are positioned in the multiplicity of different side boreholes 808, 808*a*, 808*b*, 810, 810*a*, 810*b*, 812, 812*a*, and 812*b*. The multiple explosive charges 814 are utilized to enhance the fracture network in the geothermal zone 806. The charges 814 are placed in the sidetrack boreholes and the sidetrack boreholes can be cemented off. For example, the sidetrack borehole 808*a* is shown having been cemented off at location 818.

The present invention provides the system 800 for expanding and enhancing a fracture network in the geothermal zone 806 penetrated by the boreholes. The goal of a geothermal power plant is to extract hot fluids from the reservoir at a sufficient rate so that the heat can be used to generate electricity. Often times the reservoir contains sufficient heat, but lacks the fracture permeability necessary to extract the volume of water needed for economic electrical generation. Stimulation of the reservoir to create a fracture network that accesses more of the hot reservoir volume is a technique often used to enhance a geothermal system. The rate of heat extraction depends on the temperature of the host formation, the fracture permeability and porosity, and the fracture surface area. The standard method for improving fracture networks in a geothermal reservoir is hydro fracturing or hydroshearing. The system 800 described here relies on higher strain rate stimulation methods that may include, solid, liquid, or gas propellants, explosives, and energetic materials. These methods provide fracture networks for the extraction of heat from the reservoir superior to those created by standard methods.

One implementation strategy is to drill parallel slim-hole sidetracks that extend from the main borehole. These holes are cheaper to drill and using directional horizontal drilling technology can be accurately placed. The holes will extend into the reservoir at a distance such that the emplacement and detonation of an explosive charge will not damage the main borehole. This eliminates one prior problem of using energetic materials for stimulation and adds the advantages of creating the fracture network in a location between injection and extraction boreholes. Thus, once the reservoir is stimulated, the operator can produce fluids from one set of boreholes and reinject the fluids in other boreholes creating a sustainable heat extraction process.

Explosives are widely used to break up various types of rock in mining operations. They have also been utilized to a much lesser extent, and with less success to create fracture networks in the subsurface. The main difference between the successful use of explosives in mining applications and the less successful use of explosives to create fracture networks in the subsurface is the in situ stress field. In mining, explosives are most commonly utilized near the ground surface where the in situ stresses are low and where wave reflections from free surfaces in the vicinity of the explosion lead to the propagation of release waves back toward the detonation point, giving rise to fracture-enhancing tensile stress states within the geologic medium. In contrast, the resource of interest in most energy applications, whether it is oil, gas or geothermal energy, is located deep beneath the ground surface, where there are no free surfaces to promote wave reflections, and where the in situ stress field is in a predominantly compressive stress state, which tends to suppress and inhibit fracture propagation. For these reasons, simply detonating an explosive charge in the bottom of a borehole in the subsurface is not likely to produce the desired effects.

As illustrated in FIG. 8, multiple explosive charges, either in the same borehole or in several different boreholes are utilized to create a fracture network in the subsurface. This approach relies on the interaction of stress waves emanating from multiple explosive charges to create tensile loading in regions in the vicinity of the explosives where it is desired to create a fracture network. The domain size can be controlled by varying the charge size, spacing, and timing sequence. Pulse duration can also be controlled by using different types of explosives.

In one embodiment, the present invention provides the use of explosives, or other energetic materials, to greatly expand and enhance a pre-existing fracture network created through conventional hydrofracturing techniques or other means. In the system 800, explosives that exploit more effective means of energy coupling, including the use of a working fluid as the energy transfer medium and the use of multiple charges and precision timing sequences to exploit wave interactions are used. The pre-existing fracture network 806 is first injected with a working fluid, an explosive charge 814 is then placed in the borehole within the fluid and the borehole is sealed at the top of the fluid. Upon detonation, the rapid expansion of the explosive gases leads to a pressure spike within the fluid, which is then transmitted by the fluid into the fracture network. The rapid application of this high intensity pressure pulse will lead to the initiation and propagation of new fractures connected to the pre-existing fracture network.

In a conventional sense, hydrofracturing involves the injection of water under high pressure through a borehole into a geologic formation. The pressurized water propagates into fractures, causing an increase in size and extent of the fracture network. The present invention combines explosive and/or another energetic material with conventional hydrofracturing techniques to enhance the fracture network borehole beyond what could be achieved through conventional means. This technique works by placing an explosive or energetic charge within the borehole, then detonating the charge. The energy released by the detonation will be transferred to the surrounding rock formation generating a pressure wave which will cause a significant transient increase in pressure thus leading to enhancement of the fracture network. An additional advantage of this technique is that charges can be placed in small sidetrack boreholes that are cemented off. The smaller boreholes are cheaper to drill, can be arranged in an optimal pattern, and there is no damage to the main borehole while still achieving the desired result. The smaller sidetrack boreholes are sacrificed during the detonation. Arranging the smaller boreholes in a pattern and detonating with specific and carefully planned timing enables the establishment of interfering waves to further control the resulting damage zone and fracture pattern.

Upon detonation, explosive materials undergo a rapid exothermic reaction that releases a significant amount of energy and causes a near-instantaneous rise in pressure and temperature in the detonation products. In turn, this gives rise to stress waves which propagate away from the detonation point and into the materials adjacent to the explosive. The interaction of the stress waves with the geologic medium often lead to stress states in excess of the elastic limit, leading to inelastic deformation and material damage. These inelastic processes can take many forms, including plastic deformation, porous compaction, and tensile fracture. Fracture propagation can occur under both shear and tensile loading, and the creation of optimal fracture networks under borehole controlled explosive loading conditions is the main focus of this invention.

Referring again to FIG. 8, multiple explosive charges 814, located in a multiplicity of different side boreholes 808, 808*a*, 808*b*, 810, 810*a*, 810*b*, 812, 812*a*, and 812*b* are utilized to enhance the fracture network in the productive geothermal zone 806. The charges 814 are placed in the small sidetrack boreholes and the sidetrack boreholes can be cemented off. For example, the sidetrack borehole 808*a* is shown having been cemented off at location 818.

The detonations in the parallel sidetracks can be spatially arranged and timed to create an evolving stress state that enables subsequent detonations to more effectively stimulate the rock volume. The detonations can be used to create constructive or destructive interference patterns of energy propagation to create fractures in regions away from the sidetracks. In this way the integrity of the main borehole is preserved and larger portions of the target reservoir are accessible for heat extraction.

Alternatively, a single sidetrack can extend away from the borehole into the formation and multiple charges can be placed along this borehole. The charges can then be detonated simultaneously or one-at-a-time to create the fracture network and to modify the stress field so that subsequent detonations are more effective at creating the desired fracture network. This single borehole strategy may be advantageous in some situations. For instance, in a reservoir where a fracture networks exists but it does not access portions of the reservoir, this method could target these isolated regions.

The goal of a geothermal power plant is to extract hot fluids from the reservoir at a sufficient rate so that the heat can be used to generate electricity. Often times the reservoir contains sufficient heat, but lacks the fracture permeability necessary to extract the volume of water needed for economic electrical generation. Stimulation of the reservoir to create a fracture network that accesses more of the hot reservoir volume is a technique often used to enhance a geothermal system. The rate of heat extraction depends on the temperature of the host formation, the fracture permeability and porosity, and the fracture surface area. The standard method for improving fracture networks in a geothermal reservoir is hydro fracturing or hydroshearing. The system 800 described here relies on higher strain rate stimulation methods that may include, solid, liquid, or gas propellants, explosives, and energetic materials. These methods provide fracture networks for the extraction of heat from the reservoir superior to those created by standard methods.

One implementation strategy is to drill parallel slim-hole sidetracks that extend from the main borehole. These holes are cheaper to drill and using directional horizontal drilling technology can be accurately placed. The holes will extend into the reservoir at a distance such that the emplacement and detonation of an explosive charge will not damage the main borehole. This eliminates one prior problem of using energetic materials for stimulation and adds the advantages of creating the fracture network in a location between injection and extraction boreholes. Thus, once the reservoir is stimulated, the operator can produce fluids from one set of boreholes and reinject the fluids in other boreholes creating a sustainable heat extraction process.

The detonations in the parallel sidetracks can be spatially arranged and timed to create an evolving stress state that enables subsequent detonations to more effectively stimulate the rock volume. The detonations can be used to create constructive or destructive interference patterns of energy propagation to create fractures in regions away from the sidetracks. In this way the integrity of the main borehole is preserved and larger portions of the target reservoir are accessible for heat extraction.

Alternatively, a single sidetrack can extend away from the borehole into the formation and multiple charges can be placed along this borehole. The charges can then be detonated simultaneously or one-at-a-time to create the fracture network and to modify the stress field so that subsequent detonations are more effective at creating the desired fracture network. This single borehole strategy may be advantageous in some situations. For instance, in a reservoir where a fracture networks exists but it does not access portions of the reservoir, this method could target these isolated regions.

EXAMPLE 9

Figure 9:
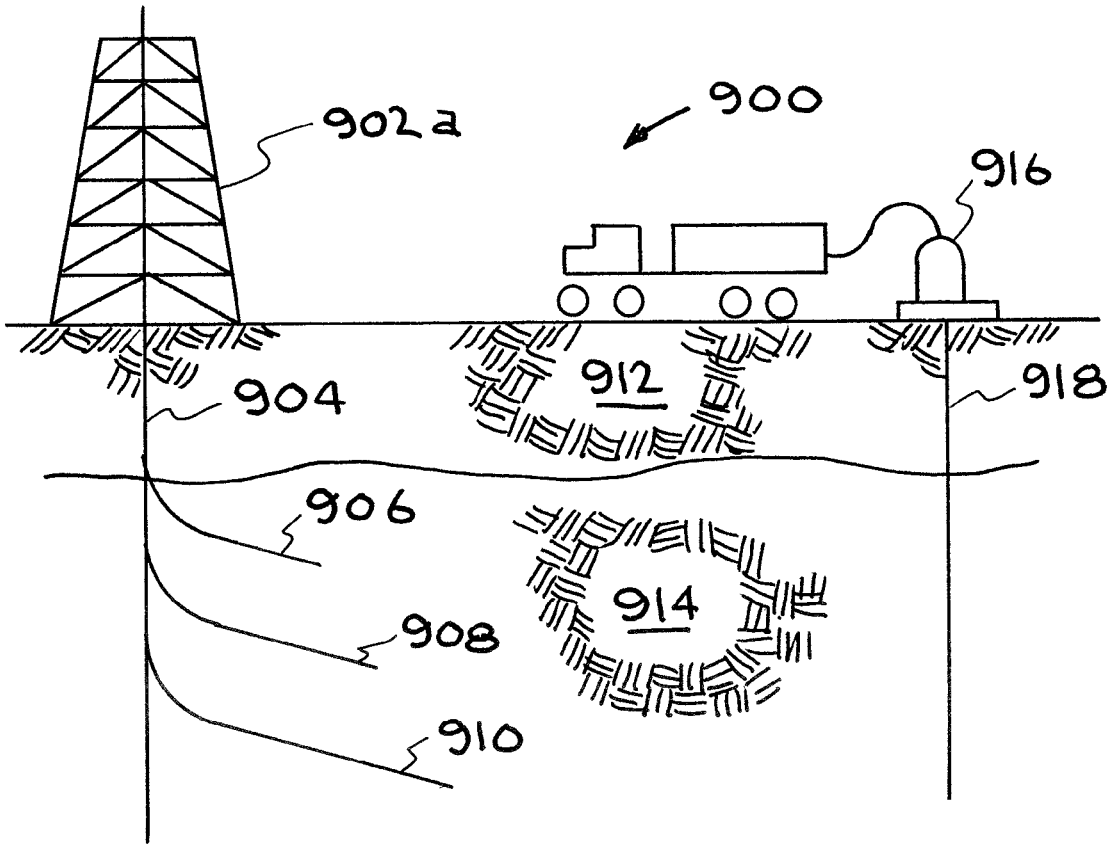
FIGS. 9 and 10 illustrate another example of the present invention.
Figure 10:
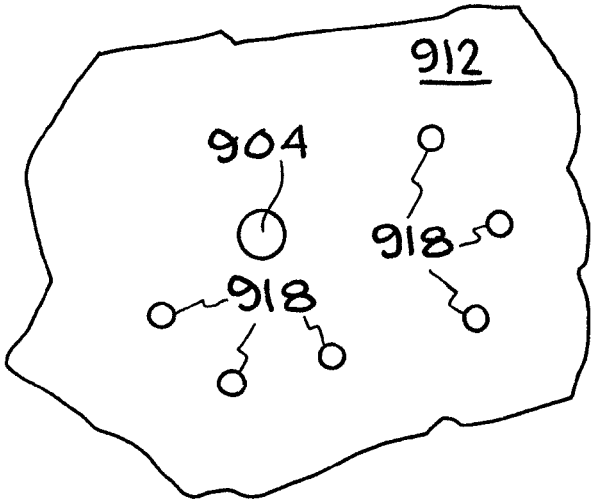

Referring now to FIGS. 9 and 10, another example of a system of the present invention is illustrated. The system of Example 9 is designated generally by the reference numeral 900. The system 900 involves arranging a multiplicity of boreholes in a pattern and detonating an energetic charge in said multiplicity of boreholes with specific and carefully planned timing enables the establishment of interfering waves to further control the resulting damage zone and fracture pattern. The system 900 provides a method and apparatus for pre-determining the location of explosive charges to maximize energetically stimulating the geological formation fracturing the geological formation resulting in the stress field in the geological formation being enhanced.

A main well 904 is shown extending into the earth 912 and into or proximate a formation 914 penetrated by the main well 904 or proximate the main well 904. The main well 904 is shown having side boreholes 906, 908, and 910 extending into the formation 914. A drilling rig 916 is illustrated drilling a multiplicity of boreholes 918 in a predetermined pattern in the vicinity of the main well 904. The boreholes 918 are located with specific and carefully planning so that the detonation of energetic charges in the multiplicity of boreholes 918 produces interfering waves to control the resulting damage zone and fracture pattern in the formation 914. Some of the tools used in the planning of the pattern of the boreholes 918 in the vicinity of the main well 904 are seismographic studies, reservoir analysis studies, and computer modeling.

FIG. 10 is a plan view of the multiplicity of boreholes 918 being drilled in a predetermined pattern in the vicinity of the main well 904. The boreholes 918 are located with specific and carefully planning so that the detonation of energetic charges in the multiplicity of boreholes 918 produces interfering waves to control the resulting damage zone and fracture pattern in the formation 914. The location of explosive charges in the boreholes 918 maximizes the energetically stimulation of the geological formation resulting in the stress field in the geological formation being enhanced.

EXAMPLE 10

Figure 11A:
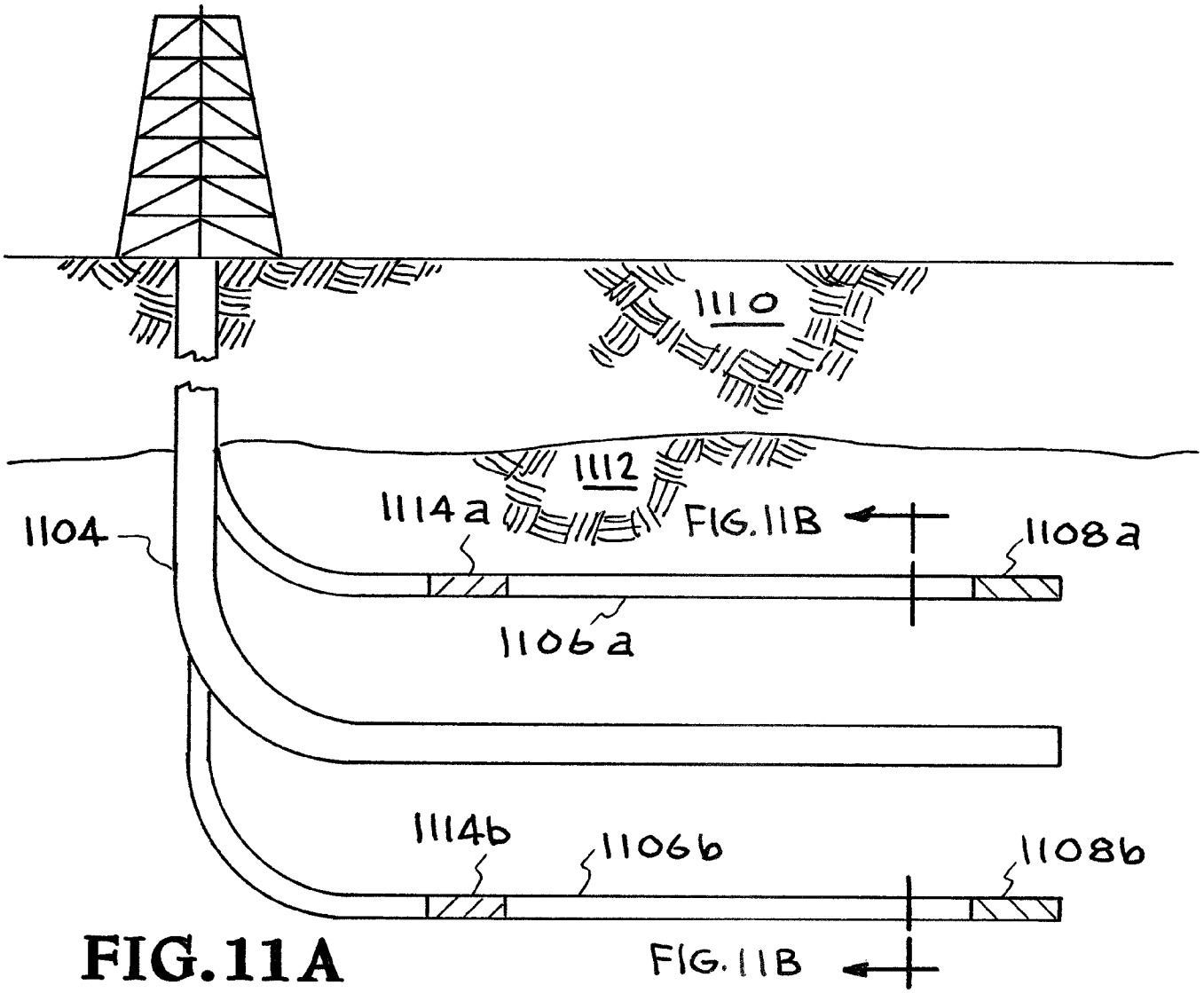
FIGS. 11A, 11B, and 12 illustrate yet another example of the present invention.
Figure 11B:
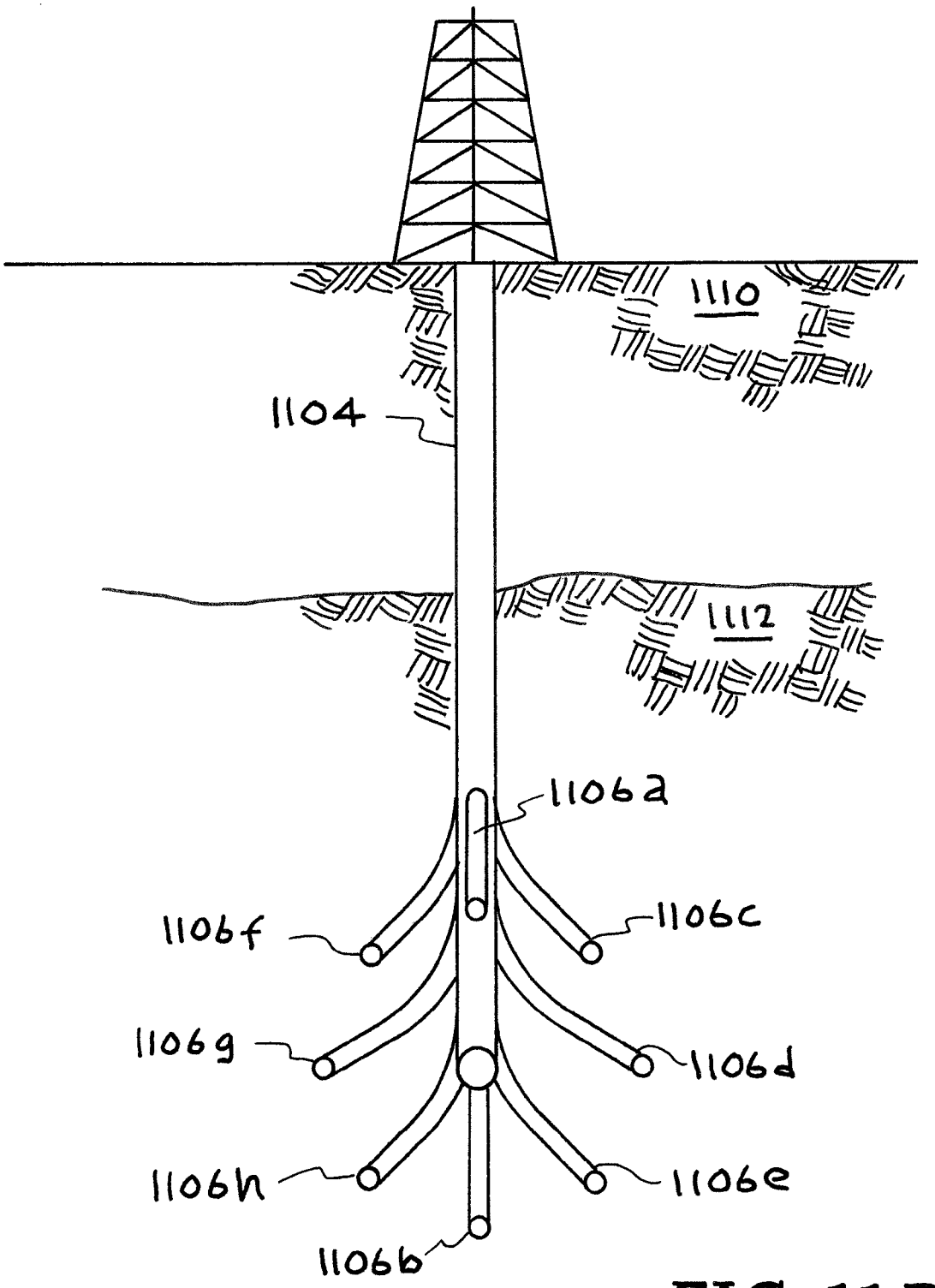
Figure 12:
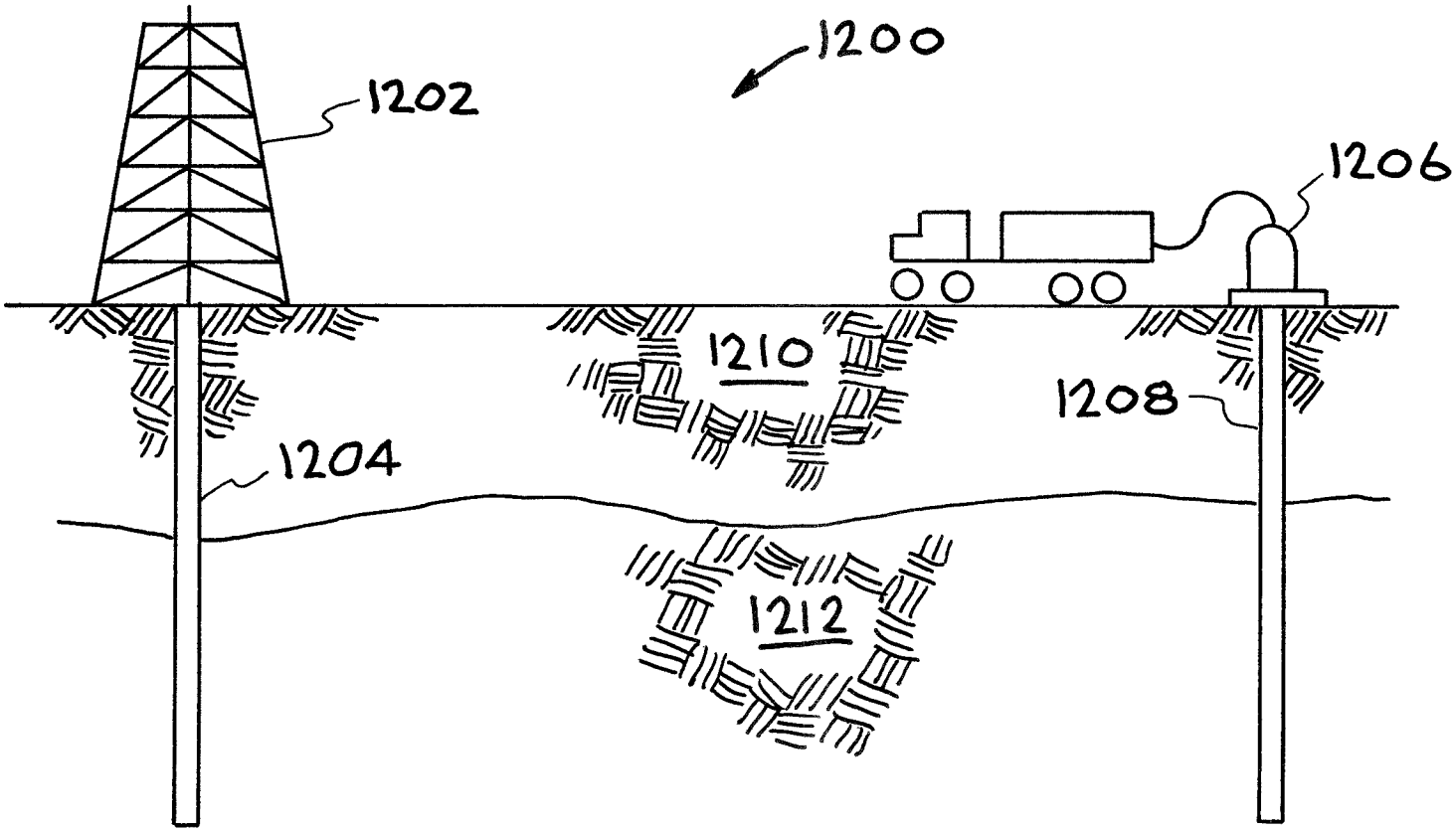

Referring now to FIGS. 11 and 12, additional examples of systems of the present invention are illustrated. The systems illustrated in FIGS. 11 and 12 provide applications that utilizes energetic materials as a means to stimulate fracture propagation in a low permeability shale formation for the purpose of extracting oil and/or gas contained in the shale. Several different variants of the application of energetic materials to stimulate the well are described. The technology could be applied to stimulate a new well, or as a post-production step to re-stimulate a well that was first produced using conventional hydraulic fracturing techniques.

Fluidless Well Stimulation:

Referring to FIGS. 11A AND 11B, a main borehole 1104 is shown extending into the earth 1110 and into or proximate a formation 1112 penetrated by the main borehole 1104 or proximate the main borehole 1104. This technology is shown applied in horizontal sacrificial boreholes 1106*a*, 1106*b*, 1106*c*, 1106*d*, 1106*e*, 1106 *f*, 1106*g*, and 1106*h*. This technology can also be applied in vertical boreholes holes which can be desirable, especially where the production zone is of sufficient thickness to render a vertical hole economical. In this case the explosives can be arranged in vertical sacrificial holes, the size and location of which are determined as was done in the case of horizontal production wells.

The series of horizontal sacrificial boreholes 1106*a*, 1106*b*, 1106*c*, 1106*d*, 1106*e*, 1106*f*, 1106*g*, and 1106*h* are drilled at specific locations extending from the production hole 1104. The system 1100 includes the steps of placing an explosive or energetic charge 1108*a*, 1108*b*, 108*c*, 1106*d*, 1106*e*, 1106*f*, 1106*g*, and 1106*h* within the sacrificial boreholes 1106*a*, 1106*b*, 1106*c*, 1106*d*, 1106*e*, 1106*f*, 1106*g*, and 1106*h*, and detonating the charges producing a detonation that creates a fracture network in the formation 1112. If it is desired to protect the production borehole 1104 sections 1114*a*, 1114*b*, 1114*c*, 1114*d*, 1114*e*, 1114*f*, 1114*g*, and 1114*h* of horizontal sacrificial boreholes 1106*a*, 1106*b*, 1106*c*, 1106*d*, 1106*e*, 1106*f*, 1106*g*, and 1106*h* may be sealed off, for example by cementing.

The production hole 1104 can be drilled and cased either before or after completion of explosive operations. The production hole can be drilled at the location that optimizes gas production from the newly created fracture network. The size and location of the sacrificial holes 1106*a*, 1106*b*, 1106*c*, 1106*d*, 1106*e*, 1106*f*, 1106*g*, and 1106*h* relative to the production hole 1104 are determined based on several factors including structural geology of the reservoir, the properties of the rock (e.g., sound speed, strength, density, existing fractures), the type of energetic materials being utilized (e.g., energy content per unit volume, energy release rate), and the in situ stress field. Detonation of the energetic materials in the different holes can be synchronized to maximize the surface area of the fracture network. Other factors can also be taken into account in the placement and detonation of the energetic materials, such as to maximize propagation of self-propped "shear fractures."

Another variant of this approach involves the utilization of explosives placed in discrete locations within a drill hole, as opposed to being placed uniformly throughout the entire length of the hole. In this case, widening of the hole to accommodate larger amounts of explosives at desirable locations may be required to achieve desired results.

Yet another variant could involve the utilization of explosives in the entire length of the sacrificial hole, except at discrete location(s), pre-determined based on site-specific information gathered prior to well stimulation. For instance, if a geologic fault intersects the resource-bearing rock, it may be desirable not to stimulate the fault zone to avoid the risk of activating the fault, and/or having the fault compromise the seal integrity of the well.

Explosive Stimulation Applied Synergistically with Conventional Stimulation Techniques The fluidless well stimulation method described above can be slightly modified and applied in combination with conventional hydraulic fracturing techniques to produce a more extensive fracture network and increase well production. With this technique, a production well is drilled, cased and completed using conventional hydraulic fracturing techniques. This is followed with another stimulation regiment using energetic materials. The explosive stimulation can be applied immediately following the hydraulic fracturing stimulation, or after the well is produced, and the yield has dropped off to sufficiently low levels to justify re-stimulation. In either case, sacrificial explosive emplacement holes are drilled in the vicinity of the production well and filled with explosives. Fluid is pumped into the production well so as to flood and fully saturate the existing fracture network. The explosives are detonated while maintaining a fluid pressure in the fracture network at or near the same level used in the initial hydraulic fracturing stage. By maintaining a high level of fluid pressure, the existing fracture network will be at or near the threshold of crack growth, thus providing favorable conditions for the explosive stimulation to produce additional new fractures. Additionally, due to the extremely high strain rates associated with explosive loading, the new fracture network will be more extensive than the original, with many branching cracks emanating from the original long fractures produced using hydraulic fracturing techniques. As in the previous case, the size and location of the sacrificial holes relative to the production hole are determined based on several factors including structural geology of the reservoir, the properties of the rock (e.g., sound speed, strength, density, existing fractures), the type of energetic materials being utilized (e.g., energy content per unit volume, energy release rate), and the in situ stress field. Detonation of the energetic materials in the different holes can be synchronized to maximize the surface area of the fracture network. Other factors can also be taken into account in the placement and detonation of the energetic materials, such as to maximize propagation of self-propped "shear fractures."

This technology can also be applied in vertical production holes, especially where the production zone is of sufficient thickness to render a vertical hole economical. In this case the explosives can be arranged in vertical sacrificial holes, the size and location of which are determined as was done in the case of horizontal production wells described above.

Another variant of this approach involves the utilization of explosives placed in discrete locations within a drill hole, as opposed to being placed uniformly throughout the entire length of the hole. In this case, widening of the hole to accommodate larger amounts of explosives at desirable locations may be required to achieve desired results.

Yet another variant could involve the utilization of explosives in the entire length of the sacrificial hole, except at discrete location(s), pre-determined based on site-specific information gathered prior to well stimulation. For instance, if a geologic fault intersects the resource-bearing rock, it may be desirable not to stimulate the fault zone to avoid the risk of activating the fault, and/or having the fault compromise the seal integrity of the well.

Referring now to FIG. 12, this technology is illustrated applied in vertical boreholes. The system of Example 10 illustrated in FIG. 12 is designated generally by the reference numeral 1200. The use of this technology applied in vertical boreholes can be desirable, especially where the production zone is of sufficient thickness to render a vertical hole economical. In this case the explosives can be arranged in vertical sacrificial holes, the size and location of which are determined as was done in the case of horizontal production wells.

The series of vertical boreholes 1208 are drilled at specific locations at predetermined locations around the production hole 1204. The system 1200 includes the steps of placing an explosive or energetic charge within the boreholes 1208 and detonating the charges producing a detonation that creates a fracture network.

The system 1200 involves arranging a multiplicity of boreholes in a pattern and detonating an energetic charge in said multiplicity of boreholes with specific and carefully planned timing enables the establishment of interfering waves to further control the resulting damage zone and fracture pattern. The system 1200 provides a method and apparatus for predetermining the location of explosive charges to maximize energetically stimulating the geological formation fracturing the geological formation resulting in the stress field in the geological formation being enhanced.

The main well 1204 is shown extending into the earth 1210 and into or proximate a formation 1212 penetrated by the main well 1204 or proximate the main well 1204. A drilling derrick or rig 1206 is illustrated drilling a multiplicity of boreholes 1208 in a predetermined pattern in the vicinity of the main well 1204. The boreholes 1208 are located with specific and carefully planning so that the detonation of energetic charges in the multiplicity of boreholes 1208 produces interfering waves to control the resulting damage zone and fracture pattern in the formation 1212. Some of the tools used in the planning of the pattern of the boreholes 1208 in the vicinity of the main well 1204 are seismographic studies, reservoir analysis studies, and computer modeling.

EXAMPLE 11

Figure 13:
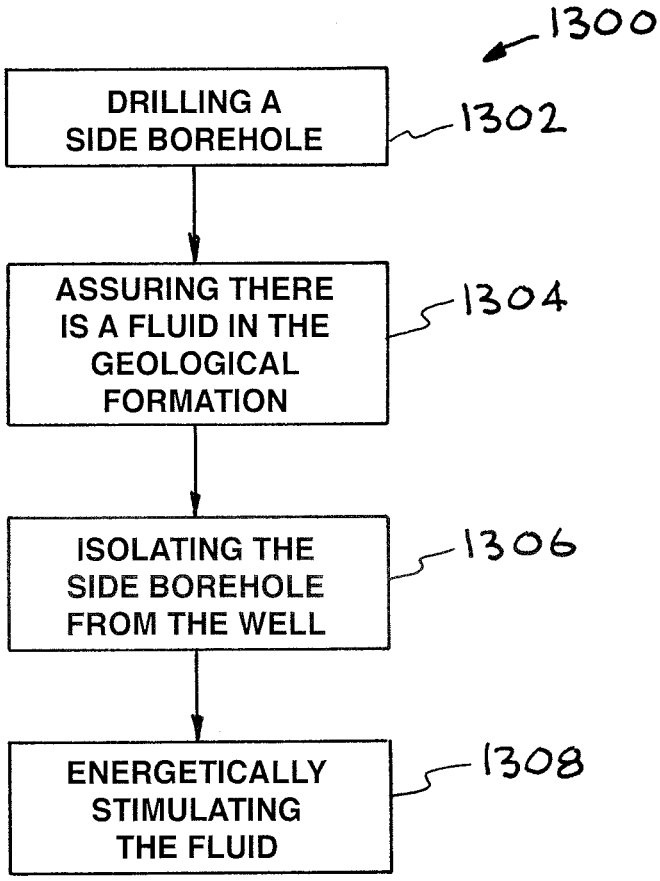
FIG. 13 illustrate another example of the present invention.

Referring now to FIG. 13, a flow chart illustrates an example of a system of another embodiment of the present invention. The system of example 11 is designated generally by the reference numeral 1100. The system 1100 is a system of fracturing a geological formation penetrated by a well or proximate the well. The present invention provides a method, apparatus, and system of fracturing a geological formation penetrated by a main borehole or proximate the main borehole. Relatively inexpensive smaller diameter sidetrack boreholes are drilled away from the main bore hole. Explosive charges are placed in these sidetrack boreholes, which are then cemented in. The detonation creates a fracture network with the desired qualities while preserving the integrity of the main borehole. Multiple side-tracks can be drilled in a pattern arranged to achieve an optimal fracture network. An additional control is the timing of the detonations to create constructively interfering energy patterns within the formation, thereby extending the stimulated zone in the subsurface. The system 1100 includes the steps shown in the flow chart.

In step 1 a side borehole is drilled from the well so that the side borehole extends into or proximate the geological formation. Step 1 is designated by the reference numeral 1102 in the flow chart of FIG. 13.

Step 2 comprises modifying the stress field in the geological formation by assuring there is a fluid in the geological formation that is in fluid communication with the borehole that has been drilled into the formation. Step 2 is designated by the reference numeral 1104 in the flow chart of FIG. 13. In one embodiment the step 1104 of modifying the stress field in the geological formation and assuring there is a fluid in the geological formation that is in fluid communication with the borehole comprises hydrofracking the geological formation.

In step 3 the side borehole is isolated from the well with the fluid pressurized producing a stress field in the geological formation. Step 3 is designated by the reference numeral 1106 in the flow chart of FIG. 13. In one embodiment the step 1106 of isolating the side borehole from the well comprises cementing off the side borehole from the well.

Step 4 comprises energetically stimulating the fluid in the geological formation fracturing the geological formation resulting in the stress field in the geological formation being enhanced. Step 4 is designated by the reference numeral 108 in the flow chart of FIG. 13. In one embodiment the step 1108 of energetically stimulating the fluid in the geological formation comprises detonating an explosive in the borehole.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A method of fracturing a geological formation, comprising the steps of:

pre-determining the location of a pattern of boreholes in or proximate the geological formation wherein said step of pre-determining the location of a pattern of boreholes in or proximate the geological formation includes pre-determining the location of a main borehole in or proximate the geological formation and pre-determining the location of side boreholes extending from said main borehole in or proximate the geological formation, drilling said pattern of boreholes into or proximate the geological formation wherein said step of drilling said pattern of borehole into or proximate the geological formation includes drilling said main borehole into or proximate the geological formation and drilling said side boreholes extending from said main borehole into or proximate the geological formation, emplacing energetic charges in said boreholes, isolating said side boreholes from said main borehole by cementing off said side boreholes from said main borehole, and detonating said energetic charges and fracturing the geological formation.

2. The method of fracturing a geological formation of claim 1 wherein said step of pre-determining the location of a pattern of boreholes in or proximate the geological formation includes pre-determining the location of said energetic charges in said boreholes in said step of emplacing energetic charges in said boreholes.

3. The method of fracturing a geological formation of claim 1 wherein said step of includes pre-determining the timing of detonating said energetic charges to enhance fracturing the geological formation.

4. The method of fracturing a geological formation of claim 1 further comprising the step of hydrofracking the geological formation following said step of drilling said pattern of boreholes into or proximate the geological formation.

5. An apparatus for fracturing a geological formation, comprising:

means for pre-determining the location of a pattern of boreholes in or proximate the geological formation wherein said means for pre-determining the location of a pattern of boreholes in or proximate the geological formation includes means for pre-determining the location of a main borehole in or proximate the geological formation and means for pre-determining the location of side boreholes extending from said main borehole in or proximate the geological formation, means for drilling said pattern of boreholes into or proximate the geological formation wherein said means for drilling said pattern of borehole into or proximate the geological formation includes means for drilling said main borehole into or proximate the geological formation and means for drilling said side boreholes extending from said main borehole into or proximate the geological formation, means for emplacing an energetic charge in said boreholes, means for isolating said side boreholes from said main borehole by cementing off said side boreholes from said main borehole, and means for detonating said energetic charge and fracturing the geological formation.

6. The apparatus for fracturing a geological formation of claim 5 further comprising means for hydrofracking the geological formation.

7. A method of fracturing a geological formation penetrated by a well or proximate the well, comprising the steps of:

drilling a side borehole from the well so that said side borehole extends into or proximate the geological formation, modifying the stress field in the geological formation by hydrofracking the geological formation producing a modified stress field, isolating said side borehole from the well with said modified stress field maintained in the geological formation wherein said step of isolating said side borehole from the well with said modified stress field maintained in the geological formation comprises cementing off said side borehole from the well with said modified stress field maintained in the geological formation, and energetically stimulating said fluid in the geological formation fracturing the geological formation resulting in said stress field in the geological formation being enhanced.

8. The method of fracturing a geological formation penetrated by a well or proximate the well of claim 7, further comprising pre-determining the location of said side borehole to increase expanding and enhancing fracturing the geological formation.

9. The method of expanding and enhancing a well of claim 7, further comprising pre-determining the location of said explosive charge to maximize said step of energetically stimulating said fluid in the geological formation fracturing the geological formation resulting in said stress field in the geological formation being enhanced.

10. The method of expanding and enhancing a well of claim 7, further comprising pre-determining the timing of detonation of said explosive charge to maximize said step of energetically stimulating said fluid in the geological formation fracturing the geological formation resulting in said stress field in the geological formation being enhanced.

11. A method of fracturing a geological formation penetrated by a main borehole or proximate the main borehole, comprising the steps of:

drilling a pattern of side boreholes from the main borehole into or proximate the geological formation, hydrofracking the geological formation, emplacing energetic charges in said side boreholes away from the main borehole, isolating said side boreholes from the main borehole by cementing off said side boreholes from said main borehole, and detonating said energetic charges and fracturing the geological formation.

12. The method of fracturing a geological formation penetrated by a main borehole or proximate the main borehole of claim 11, further comprising pre-determining the location of said side boreholes to enhance fracturing the geological formation.

13. The method of fracturing a geological formation penetrated by a main borehole or proximate the main borehole of claim 11, further comprising pre-determining the location of said energetic charges in said side boreholes to enhance fracturing the geological formation.

14. The method of fracturing a geological formation penetrated by a main borehole or proximate the main borehole of claim 11, further comprising pre-determining the timing of detonating said energetic charges to enhance fracturing the geological formation.

15. A method of energetic stimulation of a geothermal reservoir penetrated by a vertical injection well and penetrated by an extraction well, comprising the steps of:

providing a horizontal side borehole extending from the vertical injection well in the geothermal reservoir, hydrofracking the geothermal reservoir assuring there is a fluid within the geothermal reservoir, isolating said horizontal side borehole from the vertical injection well by blocking off said horizontal side borehole from the vertical injection well with said fluid in the geothermal reservoir, placing an explosive or energetic charge within said side horizontal borehole, and detonating said charge producing a pressure wave in said fluid causing a transient increase in pressure that is transferred through said fluid within the geothermal reservoir resulting in energetic stimulation of the geothermal reservoir.

16. A method of energetic stimulation of a geothermal reservoir penetrated by an injection well and penetrated by an extraction well, comprising the steps of:

drilling a multiplicity of side boreholes from the injection well so that said side boreholes extend into the geothermal reservoir, hydrofracking the geothermal reservoir resulting in a fluid in the geothermal reservoir, isolating said multiplicity of side boreholes from the injection well by blocking off said multiplicity of side boreholes from the injection well with said fluid pressurized and producing a stress field in the geothermal reservoir, and energetically stimulating said fluid in the geothermal reservoir fracturing the geothermal reservoir resulting in said stress field in the geothermal reservoir being enhanced.

17. A method of producing optimized fracture networks in a reservoir, comprising the steps of:

providing a vertical main borehole in or proximate the reservoir, providing a side horizontal borehole in or proximate the reservoir extending from said vertical main borehole in or proximate the reservoir, hydrofracking the reservoir increasing the fracture networks in the reservoir and assuring there is a fluid within the fracture networks in the reservoir, placing an explosive or energetic charge within said side horizontal borehole, isolating said side horizontal borehole from said vertical main borehole by cementing off said side horizontal borehole from said vertical main borehole, and detonating said charge producing a pressure wave in said fluid causing a transient increase in pressure that is transferred through said fluid within the fracture networks in the reservoir resulting in optimized fracture networks in the reservoir.

18. The method of producing optimized fracture networks in a reservoir of claim 17, further comprising pre-determining the location of said side horizontal borehole to enhance producing optimized fracture networks in the reservoir.

19. The method of producing optimized fracture networks in a reservoir of claim 17, further comprising pre-determining the location of said explosive charge to enhance producing optimized fracture networks in the reservoir.

20. The method of producing optimized fracture networks in a reservoir of claim 17, further comprising pre-determining the timing of detonation of said explosive charge to enhance producing optimized fracture networks in the reservoir.

21. The method of producing optimized fracture networks in a reservoir of claim 17, further comprising providing at least one additional borehole in or proximate the desired fracture zone, placing at least one additional explosive or energetic charge within said at least one additional borehole, and detonating said at least one additional charge.

22. The method of producing optimized fracture networks in a reservoir of claim 17, further comprising sealing off said at least one additional borehole prior to detonating said at least one additional charge.

23. The method of producing optimized fracture networks in a reservoir of claim 17, further comprising pre-determining the location of said borehole and said at least one additional borehole to enhance producing optimized fracture networks in the reservoir.

24. The method of producing optimized fracture networks in a reservoir of claim 17, further comprising pre-determining the location of said explosive charge and said at least one additional explosive charge to enhance producing optimized fracture networks in the reservoir.

25. The method of producing optimized fracture networks in a reservoir of claim 17, further comprising pre-determining the timing of detonation of said explosive charge and said at least one additional explosive charge to enhance producing optimized fracture networks in the reservoir.

* * * * *